US010497528B2

(12) United States Patent
Ferree

(10) Patent No.: US 10,497,528 B2
(45) Date of Patent: Dec. 3, 2019

(54) MULTI-FINGER ELECTRICAL CONTACT ASSEMBLIES , CIRCUIT BREAKERS, AND METHODS HAVING INCREASED CURRENT WITHSTAND CAPABILITIES

(71) Applicant: SIEMENS AKTIENGESELLSCHAFT, München (DE)

(72) Inventor: James Edward Ferree, Lawrenceville, GA (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 258 days.

(21) Appl. No.: 15/610,738

(22) Filed: Jun. 1, 2017

(65) Prior Publication Data

US 2018/0350545 A1 Dec. 6, 2018

(51) Int. Cl.
*H01H 1/22* (2006.01)
*H01H 73/04* (2006.01)

(52) U.S. Cl.
CPC ..... *H01H 73/04* (2013.01); *H01H 1/226* (2013.01)

(58) Field of Classification Search
CPC .... H01H 73/04; H01H 73/045; H01H 1/2041; H01H 1/205; H01H 1/226; H01H 1/22; H01H 1/221; H01H 2001/228; H01H 9/40; H01H 9/386
See application file for complete search history.

(56) References Cited

U.S. PATENT DOCUMENTS

| | | | | |
|---|---|---|---|---|
| 4,459,445 | A * | 7/1984 | Hisatsune | H01H 9/46 200/304 |
| 4,583,065 | A * | 4/1986 | Favre-Tissot | H01R 43/04 335/106 |
| 4,891,618 | A | 1/1990 | Paton | |
| 5,847,629 | A * | 12/1998 | Helms | H01H 1/226 335/16 |
| 5,898,146 | A * | 4/1999 | Beck | H01H 77/104 200/244 |
| 6,225,884 | B1 * | 5/2001 | Fischer | H01H 71/08 200/293 |
| 8,901,446 | B2 | 12/2014 | Fong | |
| 9,087,665 | B2 | 7/2015 | Ferree | |
| 9,281,144 | B2 | 3/2016 | Ferree | |
| 2012/0199449 | A1 | 8/2012 | Fong | |
| 2012/0298489 | A1 | 11/2012 | Ferree | |
| 2015/0041436 | A1 | 2/2015 | Ferree | |

* cited by examiner

*Primary Examiner* — Felix O Figueroa

(57) ABSTRACT

A multi-finger electrical contact assembly having unequal electrical resistance in current paths through each finger providing relatively high current withstand capability. The multi-finger electrical contact assembly includes three or more fingers each with a coupled conductor, wherein one or more outer fingers and coupled conductor of the assembly have greater electrical resistance than an inner finger and coupled conductor. Multi-phase circuit breakers including the multi-finger electrical contact assembly and methods are provided, as are other aspects.

20 Claims, 5 Drawing Sheets

MULTI-FINGER ELECTRICAL CONTACT ASSEMBLIES , CIRCUIT BREAKERS, AND METHODS HAVING INCREASED CURRENT WITHSTAND CAPABILITIES

FIELD

The present disclosure relates to multi-finger electrical contact assemblies, and more particularly to multi-finger electrical contact assemblies for use in electrical switching devices such as circuit breakers.

BACKGROUND

An electrical circuit breaker operates to engage and disengage a selected branch of an electrical circuit from an electrical power supply. The circuit breaker ensures current interruption, which provides protection to the electrical circuit from unwanted electrical conditions, such as continuous over-current conditions and high-current transients due, for example, to electrical short circuits. Such circuit breakers operate by separating a pair of internal electrical contacts contained within a housing (e.g., molded case) of the circuit breaker.

In many circuit breakers, one electrical contact is stationary, while the other is movable. Conventional circuit breakers may include a moving electrical contact mounted on an end of a moving (e.g., pivotable) contact arm, such that the moving electrical contact moves through a separation path. Contact separation between the moving and stationary electrical contacts may also occur manually, such as by a person moving a handle of the circuit breaker.

In the case of a tripping event (e.g., a short circuit), an armature may be de-latched so as to release the contact arm and open the electrical contacts of the circuit breaker. Under some conditions, tripping may be accomplished by a tripping mechanism wherein the armature is actuated via attraction to a magnet contained in the current path to cause de-latching of a cradle from the armature according to conventional designs.

Some circuit breakers are configured to remain in a closed state for a predetermined period after a current fault occurs wherein the stationary contacts and the moveable contacts remain in contact for a predetermined period after a current fault occurs. If the current fault continues for the predetermined period or if the current exceeds a predetermined amperage, the electrical contacts separate to an open state. These circuit breakers are rated with a current withstand rating that determines their ability to withstand a current fault for a predetermined period. Circuit breakers and other switching devices with high current withstand ratings have a wider range of applications than circuit breakers and switching devices with low current withstand ratings.

Accordingly, there is a need for circuit breakers and electrical switching devices that offer high current withstand ratings.

SUMMARY

According to a first aspect, a multi-finger electrical contact assembly is provided. The multi-finger electrical contact assembly includes three or more fingers, each finger including a moveable contact thereon, the three or more fingers arranged to have at least two outer fingers and at least one inner finger located between the at least two outer fingers, three or more electrical conductors having first ends and opposite second ends, each finger electrically coupled to a first end of an electrical conductor, and wherein an electrical resistance between a second end of an electrical conductor coupled to an outer finger and a moveable contact of the outer finger is greater than an electrical resistance between the second end of an electrical conductor coupled to the at least one inner finger and a moveable contact of the at least one inner finger.

In accordance with another aspect, a circuit breaker is provided. The circuit breaker includes at least one multi-finger electrical contact assembly including a first terminal, second terminal, three or more fingers arranged to have at least two outer fingers and at least one inner finger located between the at least two outer fingers, each finger including a moveable contact thereon configured to be contactable with the first terminal, three or more electrical conductors having first ends and opposite second ends, each finger electrically coupled to a first end of an electrical conductor, each second end of the electrical conductors coupled to the second terminal, wherein an electrical resistance between a second end of an electrical conductor coupled to an outer finger and a moveable contact of the outer finger is greater than an electrical resistance between the second end of an electrical conductor coupled to the at least one inner finger and a moveable contact of the at least one inner finger.

In accordance with another aspect, a method of increasing current withstand in a multi-finger electrical contact assembly is provided. The method includes providing at least two outer fingers, each of the at least two outer fingers having a moveable contact, providing at least one inner finger located between the at least two outer fingers, the at least one inner finger having a moveable contact, providing three or more electrical conductors, each electrical conductor having a first end and an opposite second end, first ends of the electrical conductors coupled to each of the at least two outer fingers and the at least one inner finger, and providing electrical resistance between a moveable contact of at least one outer finger and the second end of an electrical conductor coupled thereto that is greater than the electrical resistance between a moveable contact of the at least one inner finger and the second end of an electrical conductor coupled thereto.

Still other aspects, features, and advantages of the present disclosure may be readily apparent from the following detailed description by illustrating a number of example embodiments and implementations, including the best mode contemplated for carrying out the disclosure. The disclosure may also be capable of other and different embodiments, and its several details may be modified in various respects, all without departing from the scope of the present disclosure. Accordingly, the drawings and descriptions are to be regarded as illustrative in nature, and not as restrictive. The disclosure is to cover all modifications, equivalents, and alternatives falling within the scope of the claims.

BRIEF DESCRIPTION OF THE FIGURES

The drawings described below are for illustrative purposes only and are not restrictive. The drawings are not necessarily drawn to scale and are not intended to limit the scope of this disclosure in any way.

DETAILED DESCRIPTION

Figure 1A:
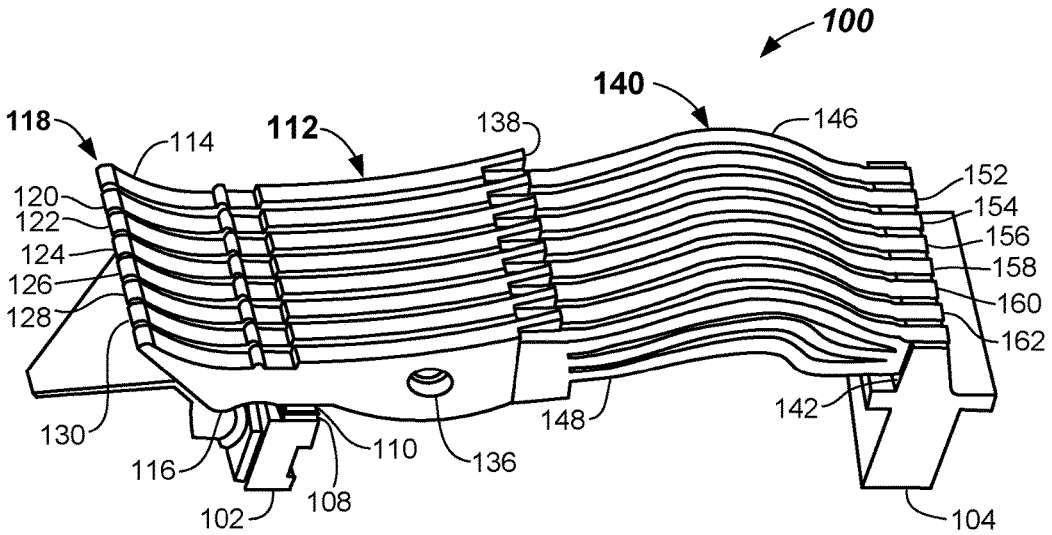
FIG. 1A illustrates an isometric view of a multi-finger electrical contact assembly shown in a closed state according to embodiments.

Embodiments of the present disclosure concern providing improved current withstand capability in multi-finger electrical contact assembles. Multi-finger electrical contact assemblies may be implemented in multi-finger circuit breakers, air circuit breakers (ACBs), and other electrical switching devices. One or more embodiments of the present disclosure provide an improved multi-finger electrical contact assembly that is operative to provide high current withstand capability.

A multi-finger electrical contact assembly may include a stationary contact configured to be coupled to a first circuit, such as a line or a power source. A plurality of moveable fingers may be configured to be electrically coupled to a second circuit, such as a load powered by the line or power supply. The plurality of fingers may have moveable contacts thereon that are configured to make contact with the stationary contact, which closes the multi-finger electrical contact assembly and enables current flow between the first circuit and the second circuit. The fingers separate from the stationary contact to open the multi-finger electrical contact assembly and prevent current flow between the first circuit and the second circuit.

Multi-finger electrical contact assemblies may be implemented in single-pole, 2-pole, and 3-pole circuit breakers and other electrical switching devices. Single-pole circuit breakers are coupled between a single line and load, 2-pole circuit breakers are coupled between a line and a load operating on two phases, and 3-pole circuit breakers are coupled between a line and a load operating on three phases. These circuit breakers may have one multi-finger electrical contact assembly coupled to each pole to enable or prevent current flow on each phase.

The multi-finger electrical contact assemblies implemented in circuit breakers may enable the circuit breakers to function as high current withstand devices. For example, in the event of a high current fault, multi-finger electrical contact assemblies within the circuit breakers may be configured to remain closed and conduct the high current until a predetermined period of time has passed. In the event that the high current fault persists longer than the predetermined period or the high current is greater than a predetermined amperage value, an internally-generated signal may trigger a mechanical operating mechanism to separate the moveable contacts from the stationary contact. The fingers and moveable contacts within the multi-finger electrical contact assemblies are configured so they do not experience physical damage as a result of conducting the high fault current for the predetermined period.

Circuit breakers and other electrical switching devices implementing multi-finger electrical contact assemblies may be characterized by current withstand ratings. The current withstand ratings specify the levels of current with corresponding time durations that the devices can tolerate or withstand without becoming damaged. Devices with high current withstand ratings may be used in a wider range of applications than devices with low current withstand ratings. Features disclosed herein increase current withstand capabilities of multi-finger electrical contact assemblies, which increases the current withstand ratings of the devices using the multi-finger electrical contact assemblies.

There are two primary physical effects that limit the current withstand capabilities of switching assemblies including multi-finger electrical contact assemblies. The first physical effect is magnetic blow-apart force caused by current constrictions in contact interfaces, such as between the moveable contacts and a contact surface. The contact surface may be the surface of a stationary contact that the moveable contacts are configured to contact. The switching assemblies are able to counteract the magnetic blow-apart forces to prevent separation of the moveable contacts from fingers to which the moveable contacts are attached. The separation of the fingers and the moveable contacts may cause arcing damage within the fingers and/or the moveable contacts. The second physical effect is heat generation caused by the high current, which causes elevated temperatures at the contact interfaces, such as between the moveable contacts and the stationary contact. The elevated temperatures may cause the moveable contacts and the contact surface of the stationary contact to weld together in some cases. Both of these physical effects are caused by high current flowing through the contact interfaces.

Achieving high current withstand capabilities is difficult in alternating current (AC) applications due to magnetic eddy current effects. The general term, "eddy current effects" is also known by the more specific terms "skin effects" and "proximity effects" and both are manifestations of eddy currents. Eddy currents are induced currents caused by the changing AC magnetic field that runs opposite to the main flow of current. Eddy currents cause current flow in electrical conductors to be non-uniform. The term, "skin effect" refers to non-uniform current in a single conductor in which higher current tends to flow at the outside surfaces of the conductor. The term, "proximity effect" refers to the mutual influence of multiple nearby conductors on the current distributions in the conductors. In multi-finger electrical contact assemblies, the skin effect causes higher current to flow through the outer fingers than through the inner fingers. Accordingly, the outer fingers and their coupled moveable contacts are subject to the effects of high current more than the inner fingers and their coupled moveable contacts.

In a 3-phase circuit breaker, the proximity effect creates an asymmetrical current distribution. For example, the outermost finger on one side of a multi-finger electrical contact assembly including side-by-side oriented fingers may have higher current flow than the outermost contact finger on an opposite side. Because the outer fingers in a multi-finger electrical contact assembly carry more current than inner fingers, the outer fingers have lower current withstand capabilities and are more vulnerable to both magnetic blow-apart and contact over-heating. Accordingly, the high current flow through the outer fingers may limit or lower the current withstand capabilities of multi-finger electrical contact assemblies. Aspects disclosed herein balance the current flow through all the fingers and may therefore increase the current withstand capabilities of multi-finger electrical contact assemblies.

The principles of the present disclosure are not limited to the illustrative examples depicted herein, but may be applied and utilized in any type of device implementing multi-finger electrical contact assemblies, including circuit breakers, electrical switches, and tripping-type electrical contact assemblies. For example, embodiments of the present disclosure may be useful in single-pole circuit breakers, duplex circuit breakers, two-pole circuit breakers, multi-pole circuit breakers, metering circuit breakers, electronic trip unit breakers, remotely-controllable circuit breakers, and the like.

These and other embodiments of the multi-finger electrical contact assemblies, circuit breakers containing the multi-finger electrical contact assemblies, and methods of improving current withstand capabilities according to the present disclosure are described below with reference to FIGS. 1A-6 herein. Like reference numerals used in the drawings identify similar or identical elements throughout the several views. The drawings are not necessarily drawn to scale.

Figure 1B:
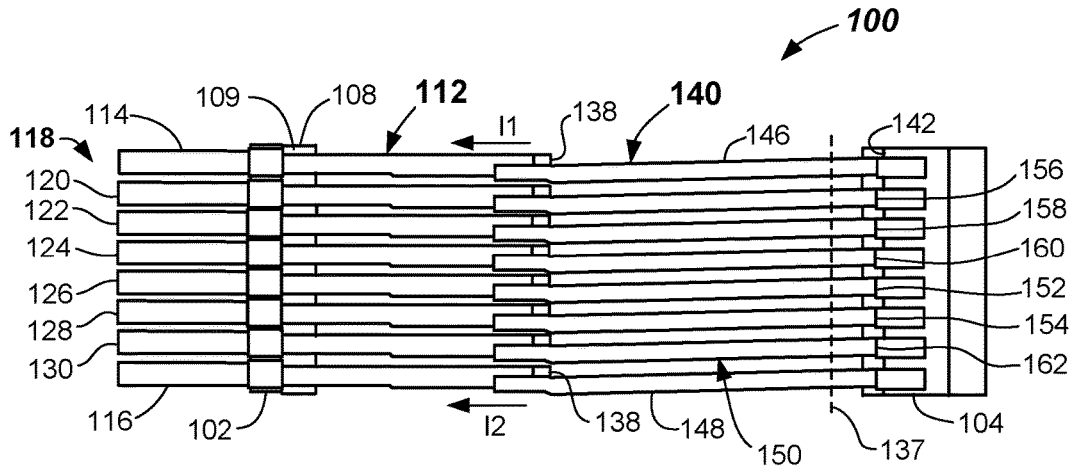
FIG. 1B illustrates a top plan view of a multi-finger electrical contact assembly of FIG. 1A according to embodiments.

Referring now to FIGS. 1A and 1B, a multi-finger electrical contact assembly 100 in a closed state is shown and described. The multi-finger electrical contact assembly 100 may be referred to herein as, "multi-finger assembly." The improved current withstand capabilities in accordance with one or more embodiments of the disclosure is included in the multi-finger assembly 100. The multi-finger assembly 100 may include a first terminal 102 and a second terminal 104. The first terminal 102 may be operative to be electrically coupled to a first circuit (not shown), such as a load or other circuit being powered by a power source. In a similar manner, the second terminal 104 may be operative to be electrically coupled to a second circuit (not shown), such as a line or a power source powering a load. The first terminal 102 and the second terminal 104 may be made of electrically conductive materials, such as copper or brass. Other materials may be used for the first terminal 102 and the second terminal 104. The multi-finger assembly 100 functions to enable or disable current flow between the first terminal 102 and the second terminal 104.

A stationary contact 108 may be electrically and mechanically coupled to the first terminal 102. The stationary contact 108 may have a contact surface 109 configured to be in contacting engagement with moveable contacts 110, to enable current flow when the contact surface 109 and the moveable contacts 110 contact each other. Such contact places the multi-finger assembly 100 in a closed state as illustrated in FIGS. 1A and 1B. Separation of the contact surface 109 and the moveable contacts 110 places the multi-finger assembly 100 in an open state (FIG. 2B). The stationary contact 108 and the moveable contacts 110 may include conductive materials, such as silver, tungsten, tungsten carbide, graphite, or combinations or alloys thereof. Other materials may be used in the stationary contact 108 and the moveable contacts 110.

Three or more fingers 112 are electrically coupled to the second terminal 104 and are electrically coupled to the first terminal 102 when the multi-finger assembly 100 is in the closed state as depicted in FIGS. 1A and 1B. The fingers 112 depicted in FIGS. 1A and 1B are arranged in a side-by side orientation with air gaps in between. Other arrangements of the fingers 112 may be used in the multi-finger assembly 100. A first finger 114 and a second finger 116 are positioned at the ends of the arrangement of fingers 112 and are referred to as, "outer fingers." At least one inner finger is positioned between the first finger 114 and the second finger 116. In the embodiment depicted in FIGS. 1A and 1B, the multi-finger assembly 100 includes six inner fingers 118 located between the first finger 114 and the second finger 116. The inner fingers 118 are referred to individually as a first inner finger 120, a second inner finger 122, a third inner finger 124, a fourth inner finger 126, a fifth inner finger 128, and a sixth inner finger 130. Each of the fingers 112 may be made of an electrically conductive material, such as copper or steel. Other materials may be used in the fingers 112.

Figure 2A:
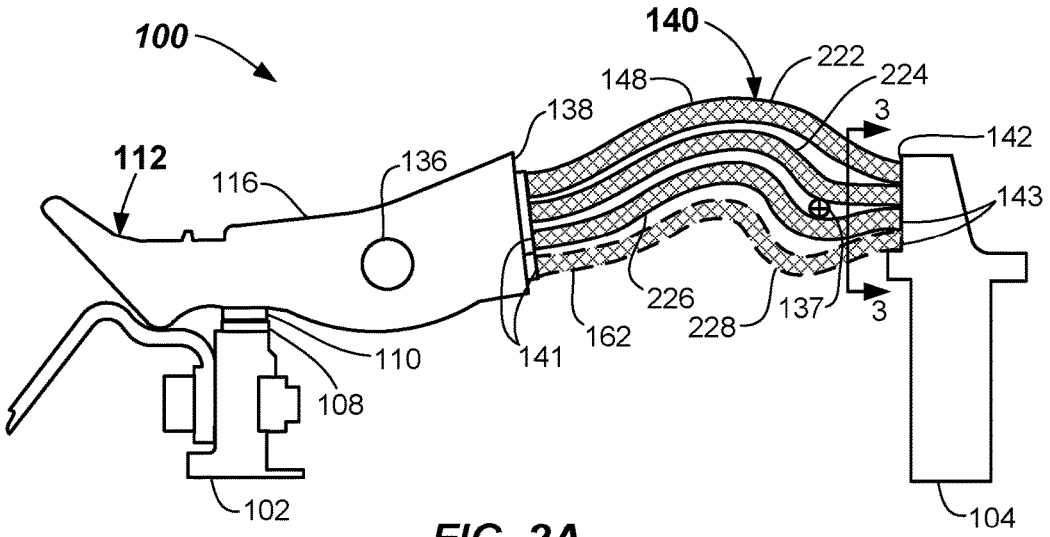
FIG. 2A illustrates a side elevation view of a multi-finger electrical contact assembly shown in a closed state according to embodiments.
Figure 2B:
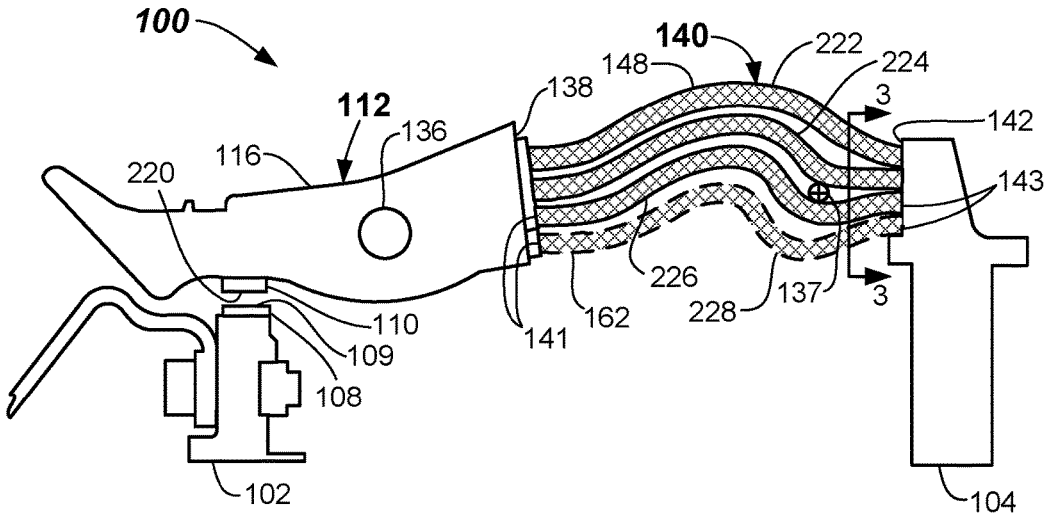
FIG. 2B illustrates a side elevation view of a same multi-finger electrical contact assembly of FIG. 2A shown in an open state according to embodiments.

Additional reference is made to FIGS. 2A and 2B. FIG. 2A illustrates a side elevation view of the multi-finger assembly 100 in a closed state, which enables current flow between the first terminal 102 and the second terminal 104. FIG. 2B illustrates a side elevation view of the multi-finger assembly 100 in an open state, which prevents current flow between the first terminal 102 and the second terminal 104. FIGS. 2A and 2B depict side elevation views of the second finger 116, which are representative of all the fingers 112. Each of the fingers 112 may have a moveable contact 110 electrically and mechanically coupled thereto. Each moveable contact 110 may have a contact surface 220 configured to contact the contact surface 109 of the stationary contact 108 when the multi-finger assembly 100 is provided in the closed state.

The fingers 112 may include a bore 136 sized and configured to receive a member (not shown) that enables the fingers 112 to pivot slightly relative to each other about an axis centered in the bore 136. Mechanical mechanisms (not shown) may be coupled to the fingers 112 to enable the fingers 112 to pivot together about an axis 137 to transition between the open state and the closed state. For example, the fingers 112 may be coupled to a carriage assembly (not shown) that pivots about the axis 137.

The fingers 112 may have ends 138 configured to be electrically and mechanically coupled to conductors 140. The conductors 140 may have first ends 141 coupled to the ends 138 of the fingers 112. The conductors 140 may have second ends 143 coupled to a side 142 of the second terminal 104. Other connection locations to the fingers 112 and the second terminal 104 may be used. The conductors 140 may function to conduct electrical current between the fingers 112 and the second terminal 104. The conductors 140 depicted in FIGS. 1A-2B may be flexible conductors that remain coupled to the fingers 112 and the side 142 of the second terminal 104 during transitions of the multi-finger assembly 100 between the open state and the closed state. The conductors 140 may be braided, twisted, or combinations of braided and twisted wire, and may be made of materials such as copper, steel, or alloys. Other conductor configurations and materials may be used for the conductors 140.

The multi-finger assembly 100 depicted in FIGS. 1A and 1B has eight conductors 140 coupled between the fingers 112 and the side 142 of the second terminal 104. Each of the conductors 140 may be formed with a plurality of conductive elements, which may be conductive strands (e.g., braids, twisted wires, or combinations) of a conductor. A first conductor 146 couples between the first finger 114 and the side 142 of the second terminal 104. A second conductor 148 couples between the second finger 116 and the side 142 of the second terminal 104. The first conductor 146 and the second conductor 148 are referred to as "outer conductors." At least one inner conductor is coupled between an inner finger and the second terminal 104. The multi-finger assembly 100 depicted in FIGS. 1A-2B has six inner fingers 118, so it may also have six inner conductors 150. Each of the inner conductors 150 may be made with a plurality of conductive elements as described herein. The inner conductors 150 are referred to individually as the first inner conductor 152, the second inner conductor 154, the third inner conductor 156, the fourth inner conductor 158, the fifth inner conductor 160, and the sixth inner conductor 162. The inner conductors 150 may couple to their corresponding inner fingers 118.

The multi-finger assembly 100 depicted in FIGS. 1A-2B has eight current paths extending between the first terminal 102 and the second terminal 104. Specifically, each of the conductors 140 and the coupled fingers 112 constitute a current path. A first current path I1 extends through the first conductor 146 and the first finger 114. A second current I2 path extends through the second conductor 148 and the second finger 116. The first current path I1 and the second current path I2 are referred to as "outer current paths." Inner current paths may extend through the inner fingers 118 and the inner conductors 150. The multi-finger assembly 100 depicted in FIGS. 1A-2B includes six inner current paths extending through the inner fingers 118 and their corresponding inner conductors 150. Embodiments of the multi-finger assembly 100 reduce the current flow in at least one of the outer current paths I1, I2 as compared to the prior art. In some embodiments, the current flow in at least one of the outer current paths I1, I2 may be approximately equal to the current flows in at least one of the inner current paths. In some embodiments, the difference between the highest current flow through an outer current path and a lowest current flow through an inner current path is less than in prior art devices that have substantially equal electrical resistance in each path.

As described above, current flow in prior art side-by-side arrangement of conductors is greatest in the outer conductors. Accordingly, the current withstand capability of a multi-finger assembly is limited by the highest current flow through any finger, which may be an outer finger. The multi-finger assembly 100 reduces the current flow in at least one of the outer current paths I1, I2 as compared to the prior art, which increases the current withstand capability of the multi-finger assembly 100. The multi-finger assembly 100 achieves the reduced current flow in at least one of the outer current paths I1, I2 by increasing the electrical resistance in at least the first current path I1 or the second current path I2 (or both) relative to the inner current paths.

Several embodiments for increasing the resistance in the first current path I1 and/or the second current path I2 relative to the resistance in the inner current paths are described herein. Some embodiments for increasing the resistance in the first current path I1 and the second current path I2 relative to the inner current paths include using conductors having smaller transverse cross-sectional areas for the first conductor 146 and/or the second conductor 148 relative to the cross-sectional areas of the inner conductors 150. In some embodiments, smaller cross-sectional areas of the first conductor 146 and/or the second conductor 148 may be achieved by using fewer conductive elements in the first conductor 146 and/or the second conductor 148 than in the inner conductors 150. In some embodiments, as best shown in FIGS. 2A, 2B and 3, the conductors 140 may be made up of several conductive elements 310, which may be conductive strands (e.g., braids, twisted wires, or combinations) of a conductor.

Figure 3:
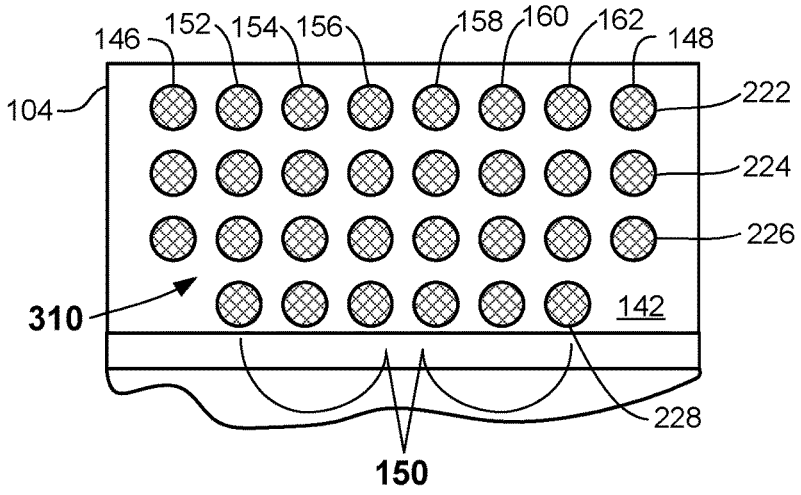
FIG. 3 illustrates a partial cross-sectional end view of a terminal and conductors in a multi-finger electrical contact assembly according to embodiments.

FIG. 3 illustrates a cross-sectional view of conductive elements 310 in the conductors 140, wherein the hatching shown denotes any one of braiding, twisting, or combinations of twisting and braiding. The first conductor 146 and the second conductor 148 each have three conductive elements 310 and the inner conductors 150 each have four conductive elements 310. Accordingly, the cross-sectional areas of the first conductor 146 and the second conductor 148 are smaller than the cross-sectional areas of the inner conductors 150. The side views of FIGS. 2A and 2B illustrate the configuration of the conductive elements 310 with regard to the second conductor 148 and the sixth inner conductor 162. As shown, the second conductor 148 has three conductive elements 222, 224, and 226. The sixth inner conductor 162 has an additional fourth conductive element 228. Accordingly, the resistances of the first conductor 146 and the second conductor 148 are greater than the resistance of the inner conductors 150. It follows that the resistances of the first current path I1 and the second current path I2 are greater than the resistances of the inner current paths having greater cross-sectional areas. In some embodiments, the first conductor 146 and/or the second conductor 148 have one or more conductive elements and the inner conductors 150 have two or more conductive elements 310, with the inner conductors 150 having more conductive elements than the first conductor 146 and/or the second conductor 148.

Other embodiments for increasing the resistances of the first current path I1 and/or the second current path I2 relative to the inner current paths include using single conductive elements having different cross-sectional areas. For example, the cross-sectional areas of conductive elements in the outer current paths may be less than the cross-sectional areas of conductive elements in the inner current paths. In other embodiments, the materials of components in the first current path I1 and/or the second current path I2 may have higher resistances than materials of components in the inner current paths. For example, the first conductor 146 and/or the second conductor 148 may include materials with higher resistances than materials in the inner conductors 150. For example, a pure (e.g., 99.9% pure) copper material may be used for the inner current paths and an alloy having lower electrical conductivity may be used for the first conductor 146 and/or the second conductor 148.

In another embodiment, the first finger 114 and/or the second finger 116 may include materials with higher resistances than materials in the inner fingers 118. For example, materials that might be used are copper alloys, where the alloying elements in addition to copper may be one or more of chromium, zinc, tin, phosphorus, aluminum, silicon, nickel, beryllium, or iron, for example.

Damage caused by high fault current may occur at the interface between the moveable contacts 110 and the contact surface 109. Accordingly, the current withstand capability of the multi-finger assembly 100 may be based on the current withstand capability of this interface. By reducing the current flow in the first current path I1 and/or the second current path I2, the interfaces between the moveable contacts 110 of the first finger 114 and/or the second finger 116 and the contact surface 109 are subjected to less current during a current fault as compared to the prior art. The current withstand capability of the multi-finger assembly 100 may therefore be improved.

The inner fingers 118, their moveable contacts 110, and the inner conductors 150 pass the current diverted from the first current path I1 and the second current path I2. The additional current flow through the moveable contacts 110 of the inner fingers 118 may increase slightly, the increased current may not be great enough to contribute to increasing the magnetic blow-apart force and heating to adversely affect the current withstand capability.

The increased resistance of the first conductor 146 and the second conductor 148 may increase the heat generated by the first conductor 146 and the second conductor 148. The heat may be generated during normal use of the multi-finger assembly 100 and during a current withstand event while the multi-finger assembly 100 remains in a closed state. A current withstand event may last between 0.05 seconds and three seconds. The fingers 112 may be sufficiently long or massive so that heat generated by the first conductor 146 and/or the second conductor 148 does not have time to conduct to the moveable contacts 110 to cause damage thereof. For example, the heat generated during normal use of the multi-finger assembly 100 may dissipate throughout a switching device in which the multi-finger assembly 100 is located. Heat generated during a current withstand event may not be high enough or be generated long enough to transfer to the moveable contacts 110.

The multi-finger assembly 100 has been described with increased resistance in the outer current paths I1 and I2. In other embodiments, the resistance of several outer current paths may be increased on one or both sides of the multi-finger assembly 100. For example, the resistance of an additional current path constituting the first inner finger 120 and the first inner conductor 152 along with the resistance of the sixth inner finger 130 and the sixth inner conductor 162 may be increased as compared to the other inner paths. Thus, the outer current paths may include current paths other than the two outermost current paths.

Figure 4:
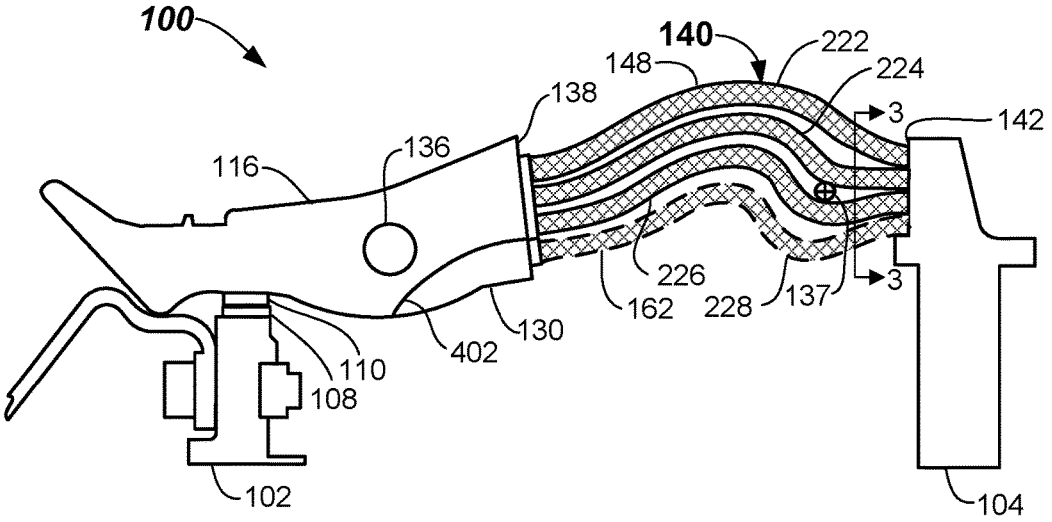
FIG. 4 illustrates a side elevation view of a multi-finger electrical contact assembly with a divot formed in an outer finger to increase an electrical resistance of the outer finger according to embodiments.

Increasing the resistance in the first current path I1 and/or the second current path I2 may be accomplished, as discussed above, within the first finger 114 and/or the second finger 116. In some embodiments, the first finger 114 and/or the second finger 116 may have higher resistances than the resistances of the inner fingers 118. For example, the first finger 114 and/or the second finger 116 may be made with materials having higher resistance than materials of the inner fingers 118 or by other means. Reference is made to FIG. 4 to illustrate an example of increasing the resistance in the second finger 116 by reducing a cross-sectional area of at least a portion of the second finger 116. In the example of FIG. 4, a divot 402 is formed into the second finger 116 to reduce the cross-sectional area of the second finger 116. Such a reduction in cross-sectional area may be located far enough from the moveable contacts 110, so that heat generated by the reduced cross-sectional area does not affect the moveable contacts 110. The location of the divot 402 may be a location of the second finger 116 having the minimum transverse cross-sectional area. The resulting minimum cross-sectional area of the second finger 116 is less than the minimum cross-sectional area of the inner fingers 118. Accordingly, the resistance of the second finger 116 is greater than the resistance of the inner fingers 118. Other implementations for reducing the cross-sectional area of a finger may be used. For example, the first finger 114 and second finger 116 may be thinner than the inner fingers 118.

The resistances of the first current path I1 and the second current path I2 may be 10%, 15%, 20%, 25%, or 35% greater than the resistances of the inner current paths. In some embodiments, the resistances of the first current path I1 and the second current path I2 may be 10%-50% or even more greater than the resistances of the inner current paths. The multi-finger assembly 100 may achieve an improvement in the achievable current withstand capability by the increased resistances. In some examples, the current withstand capability may increase up to 10% or more. The increase in the current withstand capability may be accomplished with no increase in material cost and no added parts. Rather, the material cost may be slightly reduced because fewer conductive elements or less materials are included in the conductors 140 or fingers.

Figure 5:
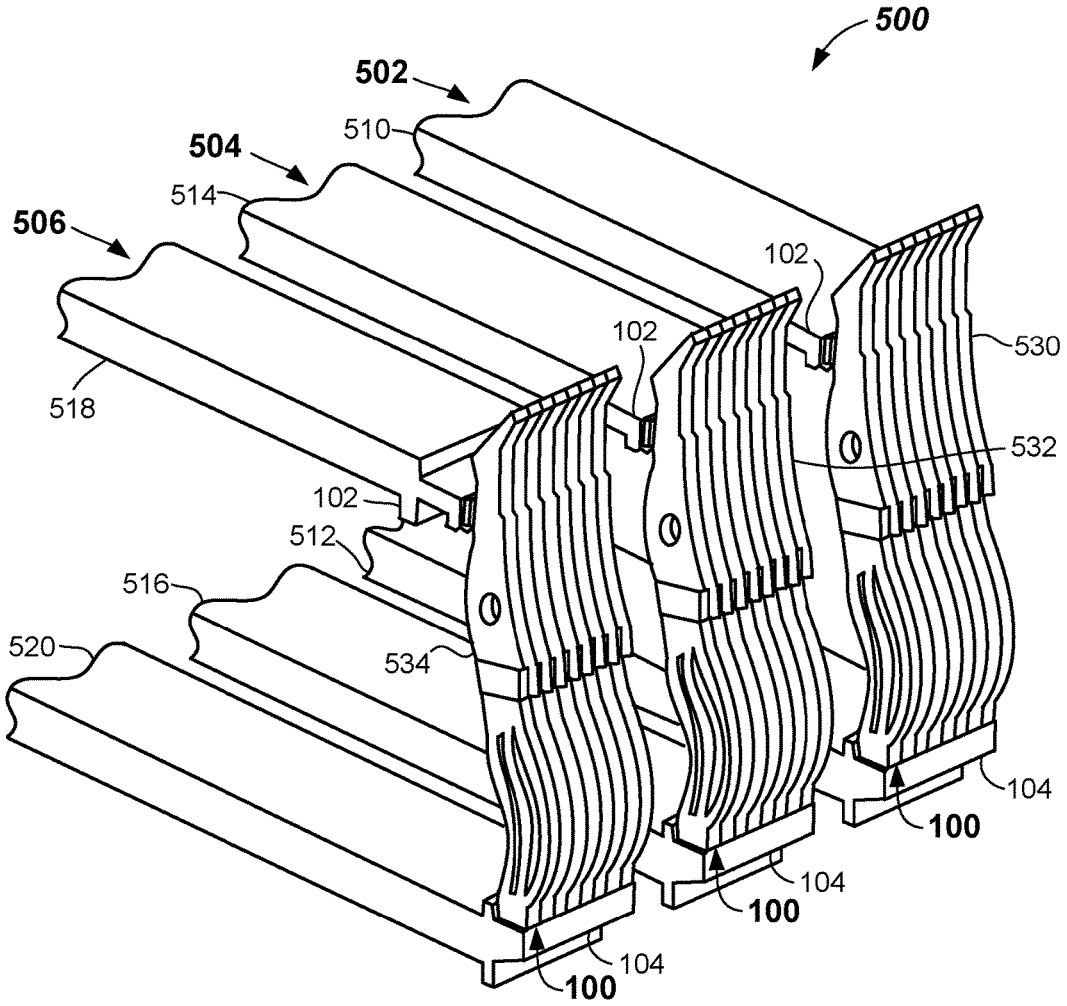
FIG. 5 illustrates an isometric view of three multi-finger electrical contact assemblies shown in a configuration implementable in a 3-pole circuit breaker according to embodiments.

FIG. 5 illustrates a configuration of three multi-finger assemblies as implementable in a circuit breaker contact assembly 500 of a 3-pole circuit breaker. The poles are referred to individually as a first pole 502, a second pole 504, and a third pole 506. Each pole includes a first terminal and a second terminal, which may be extensions of the first terminal 102 and the second terminal 104. The first pole 502 includes a first terminal 510 and a second terminal 512. The second pole 504 includes a first terminal 514 and a second terminal 516. The third pole 506 includes a first terminal 518 and a second terminal 520.

Multi-finger assemblies 100 may be coupled to the first and second terminals of the poles. A first multi-finger assembly 530 is coupled to the first terminal 510 and the second terminal 512 of the first pole 502, as shown. A second multi-finger assembly 532 is coupled to the first terminal 514 and the second terminal 516 of the second pole 504, as shown. A third multi-finger assembly 534 is coupled to the first terminal 518 and the second terminal 520 of the third pole 506, as shown. The first multi-finger assembly 530, the second multi-finger assembly 532, and the third multi-finger assembly 534 may open and close together. Accordingly, the first pole, the second pole 504, and the third pole all conduct current or are prevented from conducting current.

In other embodiments, two multi-finger assemblies may be implementable in 2-pole circuit breakers and a single multi-finger assembly may be implementable in single pole circuit breakers. In yet other embodiments, four multi-finger assemblies may be implementable in 4-pole circuit breakers.

In multi-pole switching devices, such as the 3-pole circuit breaker contact assembly 500, the current distribution in the fingers may not be symmetrical from left to right. For example, the outer finger on one side may conduct more current than the outer finger on the opposite side depending on whether the current in an adjacent pole leads or lags. In some embodiments, the resistance of the outer conductor coupled to the finger conducting the highest current is increased. In other embodiments, the resistances of both outer conductors are increased.

Figure 6:
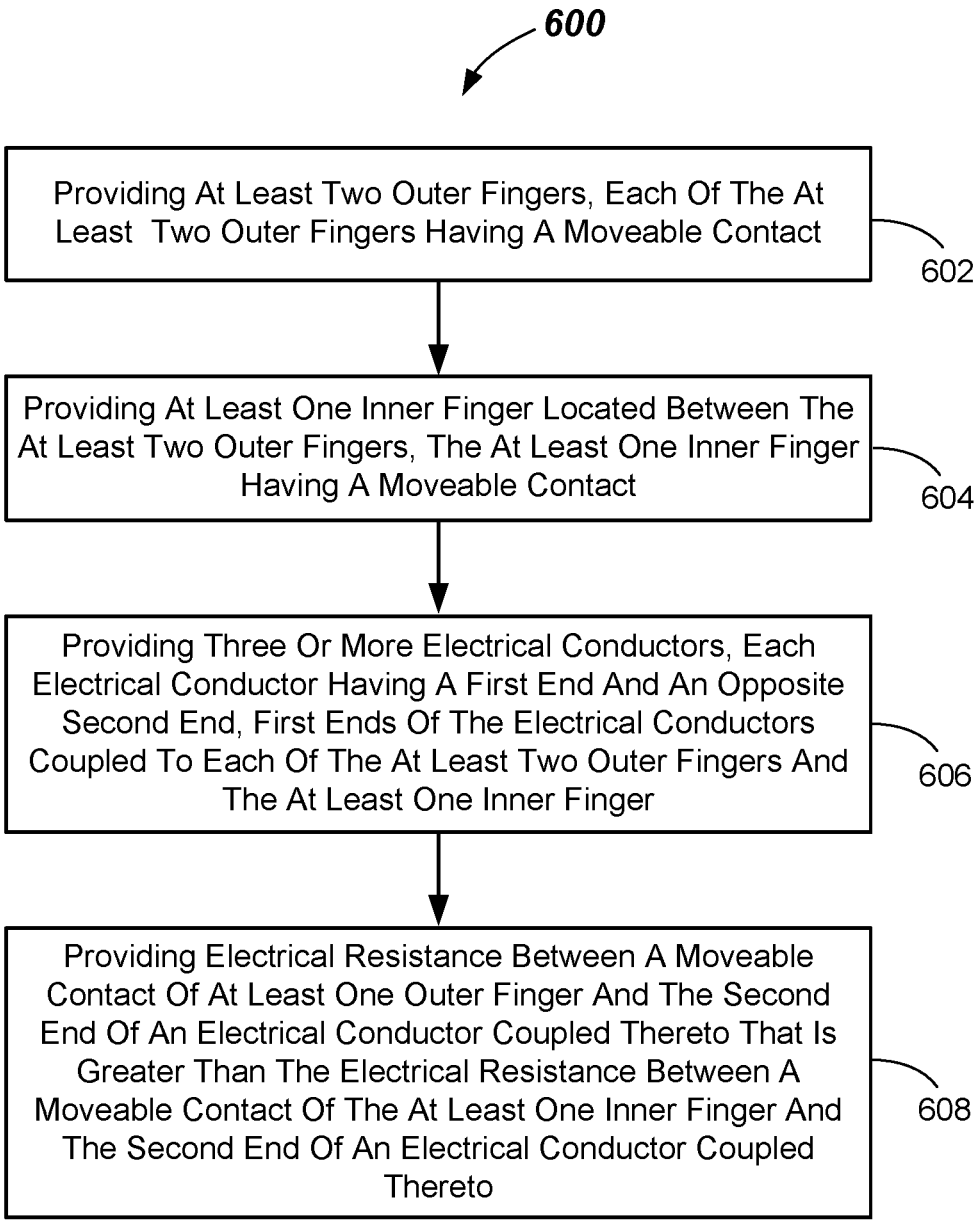
FIG. 6 illustrates a flowchart of a method of increasing withstand current capabilities in multi-finger contact assemblies according to embodiments.

FIG. 6 illustrates a flowchart of a method of increasing current withstand capabilities of a multi-finger electrical contact assembly (e.g., multi-finger assembly 100). The method 600 includes, in 602, providing at least two outer fingers (e.g., first finger 114 and second finger 116), each of the at least two outer fingers having a moveable contact (e.g., moveable contact 110).

The method 600 further includes, in 604, providing at least one inner finger (e.g., inner fingers 118) located between the at least two outer fingers, the at least one inner finger having a moveable contact (e.g., moveable contact 110). The method 600 further includes, in 606, providing three or more electrical conductors (e.g., electrical conductors 140), each electrical conductor having a first end (e.g., first ends 141) and an opposite second end (e.g., second ends 143), first ends of the electrical conductors coupled to each of the at least two outer fingers (e.g., first finger 114 and second finger 116) and the at least one inner finger (e.g., at least one of the inner fingers 118).

The method 600 further includes, in 608, providing electrical resistance between a moveable contact of at least one outer finger (e.g., first finger 114 and/or second finger 116)

and the second end of an electrical conductor (e.g., first conductor 146 and/or second conductor 148) coupled thereto that is greater than the electrical resistance between a moveable contact of the at least one inner finger and the second end of an electrical conductor coupled thereto.

The foregoing description discloses only example embodiments of the disclosure. Modifications of the above disclosed apparatus and methods which fall within the scope of the disclosure will be readily apparent to those of ordinary skill in the art. For example, the multi-finger assembly 100 may be implemented in other devices, such as manually operated electrical switches and other types of circuit breakers.

While the disclosure is susceptible to various modifications and alternative forms, specific embodiments and methods thereof have been shown by way of example in the drawings and are described in detail herein. It should be understood, however, that it is not intended to limit the disclosure to the particular apparatus, systems or methods disclosed, but, to the contrary, the disclosure is to cover all modifications, equivalents and alternatives falling within the scope of the disclosure.

What is claimed is:

1. A multi-finger electrical contact assembly, comprising:

three or more fingers, each finger including a corresponding moveable contact thereon, the three or more fingers arranged to have at least two outer fingers and at least one inner finger located between the at least two outer fingers; and three or more electrical conductors having first ends and opposite second ends, each finger electrically coupled to a first end of a corresponding electrical conductor, and wherein an electrical resistance between a second end of a corresponding electrical conductor coupled to one of the outer fingers and a corresponding moveable contact of the one of the outer fingers is greater than an electrical resistance between the second end of a corresponding electrical conductor coupled to the at least one inner finger and a corresponding moveable contact of the at least one inner finger.

2. The multi-finger electrical contact assembly of claim 1, wherein the electrical resistance between the second end of the corresponding electrical conductor coupled to the one of the outer fingers and the corresponding moveable contact of the one of the outer fingers is 10% or more greater than the electrical resistance between the second end of the corresponding electrical conductor coupled to the at least one inner finger and the corresponding moveable contact of the at least one inner finger.

3. The multi-finger electrical contact assembly of claim 1, wherein the electrical resistance between the second end of the corresponding electrical conductor coupled to the one of the outer fingers and the corresponding moveable contact of the one of the outer fingers is 15% or more greater than the electrical resistance between the second end of the corresponding electrical conductor coupled to the at least one inner finger and the corresponding moveable contact of the at least one inner finger.

4. The multi-finger electrical contact assembly of claim 1, wherein the electrical resistance between the second end of the corresponding electrical conductor coupled to the one of the outer fingers and the corresponding moveable contact of the one of the outer fingers is 20% or more greater than the electrical resistance between the second end of the corresponding electrical conductor coupled to the at least one inner finger and the corresponding moveable contact of the at least one inner finger.

5. The multi-finger electrical contact assembly of claim 1, wherein the electrical resistance between the second end of the corresponding electrical conductor coupled to the one of the outer fingers and the corresponding moveable contact of the one of the outer fingers is 25% or more greater than the electrical resistance between the second end of the corresponding electrical conductor coupled to the at least one inner finger and the corresponding moveable contact of the at least one inner finger.

6. The multi-finger electrical contact assembly of claim 1, wherein the three or more electrical conductors includes at least one flexible conductor, wherein a resistance of at least one flexible conductor electrically coupled to one of the outer fingers is greater than a resistance of at least one flexible conductor electrically coupled to the at least one inner finger.

7. The multi-finger electrical contact assembly of claim 1, wherein the corresponding electrical conductor coupled to the one of the outer fingers includes one or more conductive elements, wherein the corresponding electrical conductor coupled to the at least one inner finger includes more conductive elements than the one or more conductive elements coupled to the one of the outer fingers.

8. The multi-finger electrical contact assembly of claim 7, wherein the conductive elements are flexible conductors.

9. The multi-finger electrical contact assembly of claim 1, wherein the corresponding electrical conductor coupled to the one of the outer fingers has a first cross-sectional area, wherein the corresponding electrical conductor coupled to the at least one inner finger has a second cross-sectional area, and wherein the first cross-sectional area is less than the second cross-sectional area.

10. The multi-finger electrical contact assembly of claim 1, wherein one of the outer fingers has a first minimum cross-sectional area, wherein the at least one inner finger has a second minimum cross-sectional area, and wherein the first minimum cross-sectional area is less than the second minimum cross-sectional area.

11. A circuit breaker, comprising:

at least one multi-finger electrical contact assembly, comprising:

a first terminal;

a second terminal;

three or more fingers arranged to have at least two outer fingers and at least one inner finger located between the at least two outer fingers, each finger including a moveable contact thereon configured to be contactable with the first terminal; and three or more electrical conductors having first ends and opposite second ends, each finger electrically coupled to a first end of an electrical conductor, and each second end of the electrical conductors coupled to the second terminal, and wherein an electrical resistance between a second end of a corresponding electrical conductor coupled to one of the outer fingers and a corresponding moveable contact of the one of the outer fingers is greater than an electrical resistance between the second end of a corresponding electrical conductor coupled to the at least one inner finger and a corresponding moveable contact of the at least one inner finger.

12. The circuit breaker of claim 11, comprising two multi-finger electrical contact assemblies.

13. The circuit breaker of claim 11, comprising three multi-finger electrical contact assemblies.

14. The circuit breaker of claim 11, wherein the three or more electrical conductors includes at least one flexible conductor, wherein a resistance of at least one flexible conductor electrically coupled to one of the outer fingers is greater than a resistance of at least one flexible conductor electrically coupled to the at least one inner finger.

15. The circuit breaker of claim 11, wherein a corresponding electrical conductor coupled to the one of the outer fingers includes one or more conductive elements, wherein a corresponding electrical conductor coupled to the at least one inner finger includes more conductive elements than the one or more conductive elements coupled to the one of the outer fingers.

16. The circuit breaker of claim 11, wherein a corresponding electrical conductor coupled to one of the outer fingers has a first cross-sectional area, wherein a corresponding electrical conductor coupled to the at least one inner finger has a second cross-sectional area, and wherein the first cross-sectional area is less than the second cross-sectional area.

17. The circuit breaker of claim 11, wherein one of the outer fingers has a first minimum cross-sectional area wherein the at least one inner finger has a second minimum cross-sectional area, and wherein the first minimum cross-sectional area is less than the second minimum cross-sectional area.

18. A method of increasing current withstand capability in a multi-finger electrical contact assembly, comprising:

providing at least two outer fingers, each of the at least two outer fingers having a moveable contact;

providing at least one inner finger located between the at least two outer fingers, the at least one inner finger having a moveable contact;

providing three or more electrical conductors, each electrical conductor having a first end and an opposite second end, first ends of the electrical conductors coupled to each of the at least two outer fingers and the at least one inner finger; and providing electrical resistance between a corresponding moveable contact of one of the outer fingers and the second end of a corresponding electrical conductor coupled thereto that is greater than the electrical resistance between a corresponding moveable contact of the at least one inner finger and the second end of a corresponding electrical conductor coupled thereto.

19. The method of claim 18, comprising providing a corresponding electrical conductor having a first cross-sectional area coupled to one of the outer fingers, and providing a corresponding electrical conductor having a second cross-sectional area coupled to the at least one inner finger, the first cross-sectional area being less than the second cross-sectional area.

20. The method of claim 18, comprising providing a first electrical conductor having one or more conductive elements coupled to one of the outer fingers, and providing a second electrical conductor having two or more conductive elements coupled to the at least one inner finger, the first electrical conductor having fewer conductive elements than the second electrical conductor.

* * * * *